US007096790B1

(12) United States Patent
Wah

(10) Patent No.: US 7,096,790 B1
(45) Date of Patent: Aug. 29, 2006

(54) COMBINED FIREWORKS SHIPPING CONTAINER AND DISPLAY STAND

(75) Inventor: Ng Wing Wah, South Horizons (HK)

(73) Assignee: Shiu Fung Fireworks Co. LTD, Kowloon (HK)

( * ) Notice: Subject to any disclaimer, the term of this patent is extended or adjusted under 35 U.S.C. 154(b) by 0 days.

(21) Appl. No.: 11/100,045

(22) Filed: Apr. 6, 2005

(51) Int. Cl.
*F42B 4/26* (2006.01)

(52) U.S. Cl. ..... 102/343; 102/356; 102/358; 102/360

(58) Field of Classification Search ..... 206/730–738; 102/342–345, 351, 361, 360, 356, 358; 248/174, 248/150–159, 176.1; 239/6
See application file for complete search history.

(56) References Cited

U.S. PATENT DOCUMENTS 1,507,078 A * 9/1924 Mackie ..... 206/733
1,911,215 A * 5/1933 Walter ..... 229/120.15
1,911,678 A * 5/1933 Dunn, Jr. ..... 206/730
2,053,454 A * 9/1936 Whiteside ..... 248/524
2,153,566 A * 4/1939 Jewett et al. ..... 211/73
2,322,057 A * 6/1943 Poutinen ..... 206/348
2,642,988 A * 6/1953 Freeman ..... 206/782
2,828,047 A * 3/1958 Weiselberg ..... 206/189
3,017,018 A * 1/1962 Price ..... 206/763
3,178,227 A * 4/1965 Snyder ..... 297/440.12
3,224,618 A * 12/1965 Vigne ..... 217/26.5
3,685,640 A * 8/1972 Tolaas ..... 206/730
4,209,092 A * 6/1980 Jones ..... 206/423
4,809,847 A * 3/1989 Schneider ..... 206/45.28
4,863,094 A * 9/1989 Morrow et al. ..... 229/125.03
4,905,898 A * 3/1990 Wade ..... 239/6
D318,802 S * 8/1991 Egide ..... D9/418
D392,185 S * 3/1998 Husted ..... D9/418
5,839,590 A * 11/1998 Weiner ..... 206/577
6,116,553 A * 9/2000 McKee ..... 248/174
6,286,429 B1 * 9/2001 Marietta et al. ..... 102/342
6,371,366 B1 * 4/2002 Edgerton et al. ..... 229/162.3
6,488,200 B1 * 12/2002 Jensen, Jr. ..... 229/122.3
6,499,706 B1 * 12/2002 Sherlock et al. ..... 248/177.1
D505,321 S * 5/2005 Bechard ..... D9/418
2003/0150158 A1 * 8/2003 Wright ..... 47/41.12
2005/0133387 A1 * 6/2005 Cohen et al. ..... 206/233

* cited by examiner

*Primary Examiner*—Michael J Carone
*Assistant Examiner*—John A Radi
(74) *Attorney, Agent, or Firm*—John C. McMahon

(57) ABSTRACT

A fireworks stand for elevating fixed-position fireworks, especially cone type fountains, having a body with an inner cavity for storing the fireworks and an upper platform for supporting the fireworks during discharge. The platform is nested into an upper end of the body and receives an upper keeper that is sized and shaped to fit inside of the nested platform in order to secure the fireworks. The cavity has a lower keeper and base structure that is removed to provide access to a plurality of inserts, which house the fireworks.

18 Claims, 2 Drawing Sheets

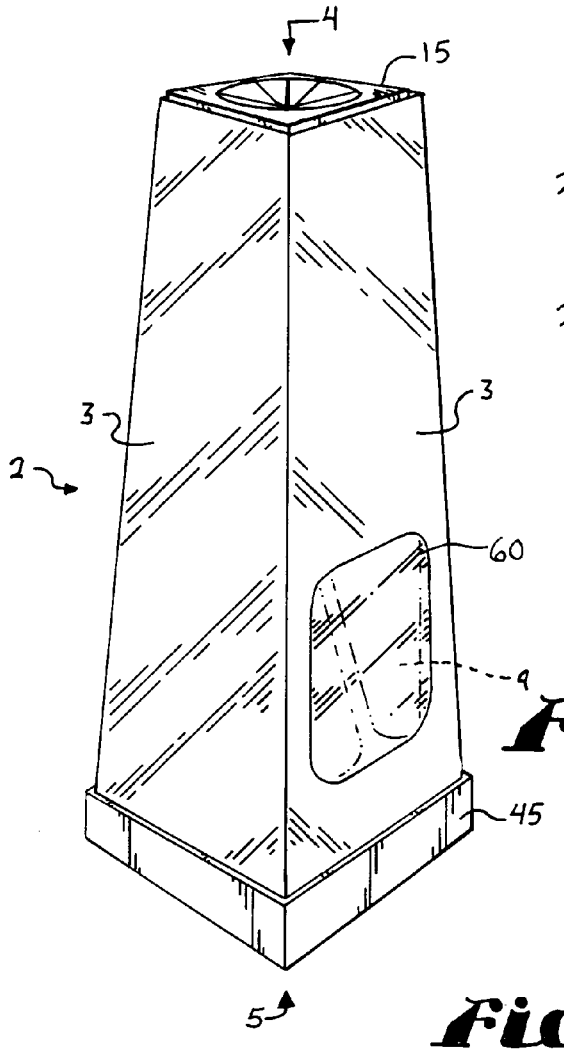
Fig.1.
Fig.3.
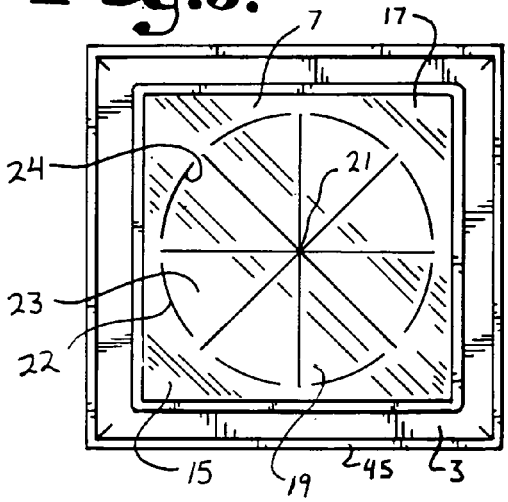
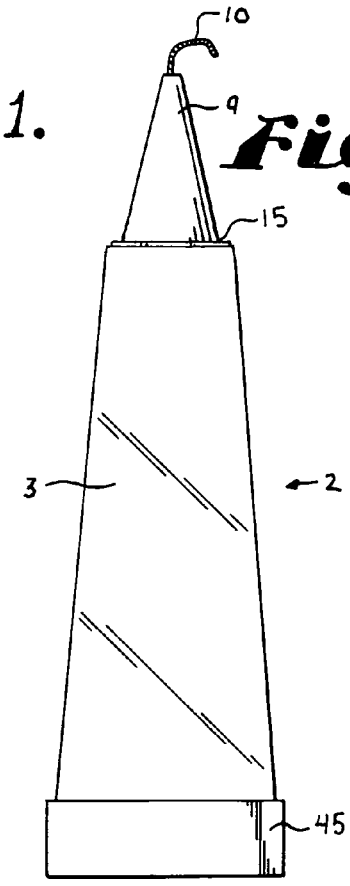
Fig.4.
Fig.5.
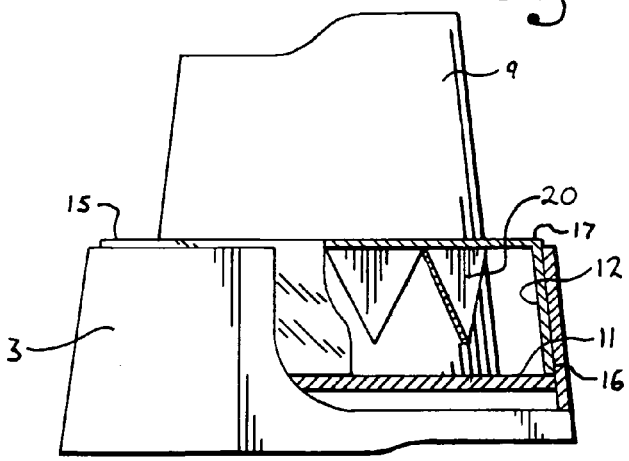

COMBINED FIREWORKS SHIPPING CONTAINER AND DISPLAY STAND

BACKGROUND OF THE INVENTION

The present invention is directed to fireworks and containers therefor and, more specifically, to an improved pyramid-shaped fireworks base having an inner fireworks storage cavity for transport and sale and a fireworks mount at an upper end of the pyramid that is equipped with a nesting platform and keeper for securely mounting fireworks for discharge and display in an elevated position.

Cones, fountains and related types of display fireworks come in many shapes and sizes designed to produce a variety of displays. Cones and fountains are popular types of firework displays that generally project an upward steady stream or varying stream of sparks to a certain height or varying heights after which the sparks flow downward in a manner intended to emulate the flow of water projected from a traditional water fountain and similar devices. The fountain effect is enhanced by maintaining airborne for as long as possible and that the sparks remain ignited for as long as possible and ideally from when the sparks exit the firework shell until the sparks contact the ground.

Such fireworks are often packaged in a cone shape structure, which are intended to be placed on the ground for safe usage. Such cones have a two fold and opposed problem. In order to be stable during discharge, the cones are manufactured with a wide base for stability such that the size of the cone is much larger than necessary to hold the actual material that is burnt to produce the fireworks effect. A second inherent limitation of such fountain displays is the height at which the display can project sparks. Consequently, cones are normally much taller and have much wider bases than is necessary to simply contain the substance of the display.

Accordingly, it is desirable to have such fountain fireworks where cones or the like can be made relatively small for transport and display at the time of sale, but whereas the cones can be stable during use and the display is elevated to provide advantages of such elevation.

For such fireworks to be used safely, support platforms for the shells must be designed to meet certain safety criteria, including that platforms not explode and provide a stable platform for launching the fireworks. In particular, a fireworks base that is designed to support a firework during discharge needs to have a minimum foot print or base size that engages the ground and stabilize the device for support. In particular, the base size is designed to provide adequate support in order to insure that the base does not upset or tip over during discharge and accidentally project its contents in an undesired sideways or lateral direction which could cause the fireworks to hit bystanders and/or create fire hazards by hitting houses, grassy areas or other highly flammable locations.

Furthermore, fireworks' shipping or merchandising boxes or packaging must be large enough to receive multiple cones. Because conventional cones must be relatively large, such packaging must also take up substantial space which is directly related to shipping, storage and display expense at the time of sale.

Accordingly, it is desirable to have such a fireworks stand where the cones or the like consume a minimal amount of space and where the overall product can be placed in a comparatively low profile package that is economical to ship and store. It is also desirable that such fireworks be lightweight, easy to use and inexpensive, so as to encourage consumers to acquire and use the product.

SUMMARY OF THE INVENTION

The present application is directed to a system and structure for providing a purchaser with a plurality of ground display fireworks in the form of cones or the like. The structure includes a container structure for holding and shipping the individual cones or other display fireworks. The container has a large footprint base that provides stability to the container when placed on the ground. The container further includes a receiver on the upper end thereof that is sized and shaped to selectively receive the individual fireworks, for example, individual cones, in an elevated position above the ground and so as to hold the fireworks in a stable manner during discharge.

Preferably, the container which becomes a stand during discharge is pyramidal shaped and has an upper platform to provide an elevated support wall for the shell during discharge. Furthermore, the stand has an inner storage cavity in order to store the individual fireworks prior to discharge and especially during shipping in order to minimize shipping costs.

OBJECTS AND ADVANTAGES OF THE INVENTION

The principal objects of the present invention are to provide a combined fireworks display stand and shipping container for individual fireworks having a pyramidal shape with a base having an upper launching platform with a receiver for holding individual fireworks, such as cones, a stable ground engaging footprint and an inner cavity for storing the individual fireworks in mass; to provide such a stand having sufficient stability to reasonably insure that the contents of the individual fireworks are directed skyward during discharge; to provide such a stand wherein it is simple to remove the fireworks from storage and to mount sequentially each of the fireworks on the stand; to provide such a stand that is manufactured out of material that is lightweight and will not form shrapnel or fragment into potentially harmful flying debris should the fireworks being used therewith malfunction and explode; to provide such a stand that does not upset or tip over easily during use; to provide such an overall system wherein the individual fireworks can be in a relatively smaller size which can be stabilized during use by frictionally mounting on the stand; and to provide such a stand which is relatively easy to use, inexpensive to produce and particularly well-suited for its intended usage.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a combined shipping container and fireworks stand having an upper platform with a fireworks receiver keeper, a base, and a side-view window in accordance with the present invention.

FIG. 3 is an enlarged top plan view of the fireworks stand.

FIG. 4 is a side plan view of the fireworks stand with an individual fireworks device mounted in the receiver of the upper platform.

FIG. 5 is an enlarged and fragmentary side elevational view of the fireworks stand illustrating an individual fireworks device mounted in the receiver with portions broken away to show detail thereof.

DETAILED DESCRIPTION OF THE INVENTION

Figure 2:
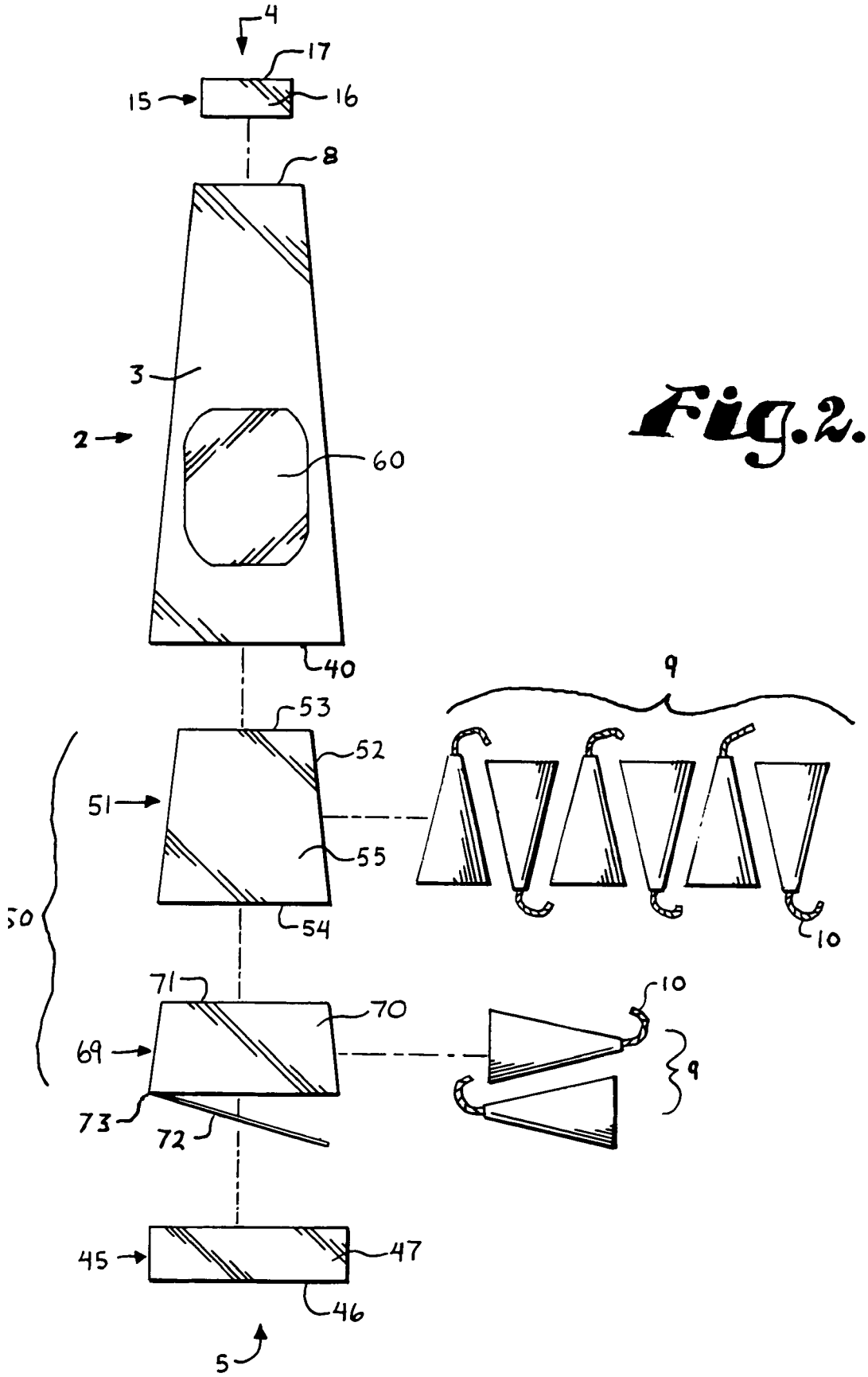
FIG. 2 is an exploded side elevational view of the fireworks stand showing fireworks contained therein during transport.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally identifies a combined shipping container and fireworks stand in accordance with the present invention. The stand 1 includes a body 2 that is pyramidal shaped with four outer side walls 3. The illustrated body 2 is substantially taller than wide at the bottom thereof. The side walls 3 extend along the entire length of the body 2, which has upper and lower ends 4 and 5. Near the upper end 4 is a platform 7 with a nested individual fireworks receiver 8 for receiving a fireworks cone 9. It is foreseen that the individual fireworks displays could be packaged in other sizes and shapes than a cone that can be received in the receiver 8. When one of the cones 9 is nested into the receiver 8 as depicted in FIG. 5, the cone 9 rests against a bottom wall 11 of the receiver 8, which is surrounded by four perimeter side walls 12. An upper keeper 15 with side walls 16 and a top wall 17 is used to secure each cone 9 in the receiver 8. Specifically, the keeper 15 has a plurality of pre-shaped panels 19 separated by slits 20 that radiate outward from a central point 21 and connected by a hinge 22, formed integrally from a portion of the platform 7 to an outer circumference or perimeter 23 of the keeper 15, thus forming a plurality of articulatable wedges 24, which are designed to engage and secure the fireworks cone 9.

In particular, FIG. 5 shows a cone 9 being held and secured by the friction and bias produced by pushing the cone 9 into the keeper. The wedges 20 are pointed and stabilize the mounted cone 9 and resist removal or twisting, but allow the fully discharged cones 9 to be removed by a user and replaced by a new cone 9.

As noted above, each cone 9 is placed within the receiver 8 and abuts against the bottom wall 11 so that the cone 9 penetrates and extends through the keeper 15 biasing the wedges 24 downwardly. Due to a natural inward bias of the wedges 24 against the circumference of the cone 9, the cone 9 fits snugly within the keeper 15. Furthermore, the keeper side walls 16 are sized and shaped to fit snugly against the receiver perimeter walls 12, so as to provide an overall stable structure.

Within the body 2 and side walls 3 is an inner cavity 40 for storage of the cones 9. The cavity 30 is accessed via a selectively removable base portion or lower cover 45. The cover 45 has bottom and side walls 46 and 47, with the side walls 47 sized and shaped to fit snugly around the outside of the body 2 and side walls 3, which extend into the cover 45. The cover 45 engages the ground with a sufficient foot print to stabilize and support the body 2 and maintain the stand 1 in an upward direction.

In the illustrated embodiment, the cavity 40 is sized and shaped to receive two inserts 50 that matingly reflect the pyramidal configuration of the body 2 and contain the cones 9. A first and upper insert 51 has four side walls 52 that fit snugly against the inner walls 12 when inserted in the body 2 and has upper and lower walls 53 and 54. The side walls 52 join the upper and lower walls 53 and 54 on all four pyramidal sides 52. One of the sides 52 has a window opening 55 provided to allow a user to see the cones 9 at the time of sale. Furthermore, when inserting the first insert 51 into the cavity 40, the opening 55 is designed to be aligned with a clear not solid display window 60 located in one of the outer side wall 3. The display window 60 provides viewing of the contents of the first insert 51 when installed in the cavity 40 at the time of sale. The insert 51 is sized and shaped so that the insert side walls 52 engage the cavity side walls 12 simultaneously and the upper wall 53 abuts the receiver bottom wall 11. A second insert 69 which is also pyramidal shaped is positioned below the first insert 51. The second insert 69 has four side walls 70 that are sloped inwardly at a degree that correspond with the sloped outer side walls 3 of the pyramidal body 2 and that connect upper and lower walls 71 and 72. The second insert 69 is loaded into the cavity 40 after the first insert 51 is loaded and in the same manner and like the first insert 51 holds additional cones 9. In order to access the second insert 69, the insert 69 has a hinge 73 that attaches the lower wall 72 to one of the four side wall 70, thus allowing the lower wall 72 to swing open or closed as the user so desires. Notably, the present design allows users quick and easy access to the contents of the second insert 69 by first removing the lower cover 45, at which point the user can pull the hinged lower wall 72 open for access with or without requiring the complete removal of the insert 69. The cones 9 in the first insert 51 are accessed by removing the first insert 51 from the body 2 and then removing the cones 9 through the opening 55.

In use, the first insert 51 is placed into the cavity 40 with the opening 55 aligned with the window 60 and the upper wall 53 of the first insert 51 abutting the bottom wall 11 of the receiver 8. Then, the second insert 69 is installed with the upper wall 71 of the second insert 69 abutting the lower wall 54 of the first insert 51. Finally, the lower cover 45 is fitted around the side walls 3 of the body 2 in order to close the cavity 40 and secure the inserts 50 with cones 9 therein.

The fireworks stand 1 is intended to be conveyed to consumers as a complete package and with the inserts 50 already loaded with a plurality of cones 9. Therefore, in order to remove the cones 9 from the inserts 50, the above detailed process is reversed. In order to install a cone 9 into the receiver 8 all of the cones 9 are removed from the inserts 50. The user then takes a single cone 9 and places it into the nested receiver 8 with a cone fuse 10 directed upward and secured in the keeper 15. At this point, the device 1 and cone 9 are ready for use and the fuse 10 is lit to discharge the contents of the mounted cone 9. Thereafter, the process is repeated until all of the cones 9 are used.

It is to be understood that while certain forms of the present invention have been illustrated and described herein, it is not to be limited to the specific forms or arrangement of parts described and shown.

What is claimed and desired to be secured by Letters Patent is as follows:

1. A combined fireworks stand and container in combination with a plurality of fireworks comprising:

a) a ground engaging base having a body and an inner cavity sized and shaped to operably store said fireworks during transport; and b) a receiver located at an upper end of the body for mounting said fireworks during discharge of the fireworks; said receiver having a bottom wall separating a remainder of said receiver from said inner cavity; said bottom wall being positioned to operably receive said fireworks thereon and support said fireworks during discharge of the fireworks; said receiver having a keeper that is sized and shaped to frictionally engage the fireworks and cooperate with said bottom wall so as to secure said fireworks one at a time within the receiver for discharge.

2. The stand according to claim 1 wherein:

a) said body is a truncated pyramid-shaped body having four side walls.

3. The device according to claim 2 wherein:

a) one of said side walls has a window for viewing the contents of the inner cavity; said window being constructed of clear material so as to allow viewing of the contents of the body therethrough.

4. The device according to claim 1 wherein:

a) said receiver is a nested receiver having a lower wall and four inner side walls.

5. The device according to claim 1 wherein:

a) said receiver has an upper member and four side walls.

6. The device according to claim 5 wherein:

a) said upper member has a number of slits that radiate outward from a central point; and b) said slits form triangular sections that are biased in a horizontal configuration and are sized and shared to frictionally engage each of said fireworks when positioned in said receiver.

7. The device according to claim 6 wherein:

a) said triangular sections are hinged and fold downwardly to accommodate a selected one of said fireworks and thereby interferingly hold said selected fireworks within the receiver.

8. The device according to claim 1 wherein:

a) said inner cavity is adapted to house at least one insert for storing said fireworks.

9. The device according to claim 1 wherein:

a) said inner cavity is adapted to house two inserts for storing said fireworks.

10. The device according to claim 9 wherein:

a) said inserts comprise an upper insert and a lower insert.

11. The device according to claim 10 wherein:

a) said upper insert has an opening that aligns with an outer window located in one of the side walls for displaying the contents of said upper insert.

12. The device according to claim 10 wherein:

a) said inserts are slidably and snugly received by said cavity.

13. The device according to claim 1 wherein:

a) said cavity is closed by a lower keeper that is sized and shaped to be received on a lower end of said body.

14. The device according to claim 13 wherein:

a) said lower keeper has a bottom wall and four side walls.

15. The device according to claim 13 wherein:

a) said lower keeper is slidably and snugly received by said body.

16. The device according to claim 13 wherein:

a) said lower keeper has a sufficiently sized footprint to provide stability to the body.

17. The device according to claim 1 wherein:

a) said fireworks are cone type fireworks that emit sparks skyward during discharge.

18. In the combination of a fireworks device that emits sparks skyward and a fireworks stand for supporting said fireworks device; the improvement comprising:

a) said stand including a body having an inner cavity adapted to receive and store said fireworks device prior to discharge, an upper receiver and a fireworks launching platform outside of said cavity; said platform being positioned to receive said fireworks device during discharge; said launching platform having a bottom wall operably separating said receiver from said cavity; said receiver having a keeper sized and shaped to cooperate with said platform and to frictionally engage and secure said fireworks device while said fireworks device is on said platform during discharge of the fireworks; said stand further including a lower ground engaging support base.

* * * * *